United States Patent [19]

Ueyama

[11] Patent Number: 4,737,397

[45] Date of Patent: Apr. 12, 1988

[54] HEAT-SENSITIVE TRANSFERRING RECORDING MEDIUM

[75] Inventor: Seiji Ueyama, Hirakata, Japan

[73] Assignee: General Company Limited, Osaka, Japan

[21] Appl. No.: 759,854

[22] Filed: Jul. 29, 1985

[30] Foreign Application Priority Data

Jul. 1, 1985 [JP] Japan ..... 60-144206

[51] Int. Cl.[4] ..... B41M 5/26

[52] U.S. Cl. ..... 428/212; 428/195; 428/484; 428/488.1; 428/913; 428/914

[58] Field of Search ..... 428/484, 488.1, 488.4, 428/913, 914, 195, 212

[56] References Cited

U.S. PATENT DOCUMENTS 3,035,936 5/1962 Roulston ..... 428/488.4
3,944,695 3/1976 Kosaka et al. ..... 428/488.1
4,503,095 3/1985 Seto et al. ..... 428/914
4,505,983 3/1985 Kuroda et al. ..... 428/913
4,559,273 12/1985 Kutsukake et al. ..... 428/488.4

FOREIGN PATENT DOCUMENTS 0054598 3/1984 Japan ..... 428/488.1

*Primary Examiner*—Bruce H. Hess
*Attorney, Agent, or Firm*—Wegner & Bretschneider

[57] ABSTRACT

A heat-sensitive transferring recording medium comprises a substrate and a heat-sensitive transferring ink layer overlying the substrate, the heat-sensitive transferring ink layer comprising a coloring agent and two kinds of waxes having melting point of 70°-90° C., penetration (JIS K 2235) of not higher than 5 at 25° C. and specific gravity of 0.99-1.05, one of the waxes having acid value of 120-160 and saponification value of 140-190 and the other having acid value of 1-20 and saponification value of 70-100.

2 Claims, No Drawings

HEAT-SENSITIVE TRANSFERRING RECORDING MEDIUM

BACKGROUND OF THE INVENTION

1. Field of the Invention

This invention relates to a heat-sensitive transferring recording medium which may be used for heat-sensitive transferring recording apparatuses such as thermal facsimile, thermal printer and the like.

2. Description of the Prior Art

Heat-sensitive transferring system has been recently remarkably developed and used in printers and facsimile since the system has various advantages as compared with conventional impact type recording system, that is, there is no noise upon printing, the printed images are clear and of high quality and the durability of record is excellent.

Many patent applications directed to heat-sensitive transferring recording mediums have been filed. For example, Japanese Patent Application Laid-open No. 15446/1976 proposes a medium using coloring materials (heat-sensitive transferring ink) which have melting point, sublimation temperature, and softening point higher than 60° C. and are solid or semi-solid at room temperature. In addition, Japanese Patent Application Laid-open Nos. 81246/1978, 163044/1979 and others propose heat-sensitive transferring recording mediums.

However, there are not yet heat-sensitive transferring recording mediums giving satisfactory improvements in smudge and printing clearness.

SUMMARY OF THE INVENTION

An object of the present invention is to provide a heat-sensitive transferring recording medium free from the above-mentioned drawbacks.

Another object of the present invention is to provide a heat-sensitive transferring recording medium capable of producing clear printing images free from irregular printing and smudge.

According to the present invention, there is provided a heat-sensitive transferring recording medium comprising a substrate and a heat-sensitive transferring ink layer overlying the substrate, the heat-sensitive transferring ink layer comprising a coloring agent and two kinds of waxes having melting point of 70°–90° C. penetration (JIS K 2235) of not higher than 5 at 25° C. and specific gravity of 0.99–1.05, one of the waxes having acid value of 120–160 and saponification value of 140–190 and the other having acid value of 1–20 and saponification value of 70–100.

DESCRIPTION OF THE PREFERRED EMBODIMENTS

The substrate may be a heat resistant substrate, for example, composed of a plastic film or paper base provided with a heat resistant protective layer.

Where melting point, penetration (JIS K 2235), and specific gravity of the waxes are outside of the ranges of the present invention, there occurs smudge and the printed images are not clear.

Even if the melting point, penetration and specific gravity are within the range, there occurs irregularity of density of printed images and quality of printed images is poor.

As the waxes, there may be used waxes which are usually used for heat-sensitive transferring recording mediums, such as carnauba wax, montan wax, oxidized wax, paraffin wax, microcrystalline wax, low molecular weight polyethylene wax and the like, provided that they satisfy the conditions of the present invention.

The coloring agent includes that usually used for heat-sensitive transferring recording mediums such as carbon black, ultramarine, lake red and the like.

If desired, a softening agent is added to the heat-sensitive transferring ink layer. The softening agent may be various oils such as animal oil, vegetable oil, mineral oil, and the like.

The substrate includes a plastic film such as polyimide, polyester, nylon and the like, and a paper base such as condenser paper, glassine paper and the like.

In case that the substrate is provided with a heat resistant protective layer, the layer may be a thin film of fatty acid amides, fluorocarbon polymers, silicone resins or the like.

EXAMPLE

To the front surface of a condenser paper of 10μ thick was applied a heat resistant protective coating material composed of a fatty acid amide dissolved in toluene by a solvent coating method to form a heat resistant protective layer of 0.3 g/m$^2$.

Then, to the back surface of the condenser paper was applied an ink shown in the table below by a hot melt coating method to form a heat-sensitive transferring ink layer of 5 g/m$^2$. Printing was carried out by using TN 5000 (tradename, manufactured by Toshiba /K.K.). The results are as shown in the table below. The amount is parts by weight.

| | | Sample Nos. | | | | |
|---|---|---|---|---|---|---|
| | | 1 | 2 | 3 | 4 | 5 |
| Materials | Oxidized wax<br>Specific gravity 1.00;<br>Acid value 130;<br>Melting point 85° C.;<br>Penetration 5;<br>Saponification value 160 | 48 | 48 | 48 | | |
| | Carnauba wax<br>Specific gravity 0.999;<br>Saponification value 82;<br>Acid value 8;<br>Melting point 83° C.;<br>Penetration <1 | 47 | | | 48 | |
| | Oxidized wax<br>Specific gravity 0.98;<br>Acid value 13;<br>Melting point 77° C.<br>Penetration 7;<br>Saponification value 105 | | 47 | | 47 | 47 |
| | Specific gravity 0.97;<br>Acid value 57;<br>Melting point 66.4° C.;<br>Penetration 5;<br>Saponification value 63 | | | 47 | | 48 |
| | Coloring agent | 5 | 5 | 5 | 5 | 5 |
| Evaluation | Irregular printing | | Δ | Δ | Δ | Δ |
| | Smudge | | Δ | Δ | Δ | Δ |
| | Clearness of printed images | | Δ | Δ | Δ | Δ |
| | Overall evaluation | | Δ | Δ | Δ | Δ |

: Good
Δ: Practically not usable

As shown above, simply mixing two different kinds of waxes can not give the advantages contemplated in this invention unless the two waxes satisfy the conditions, the physical and chemical characteristics, as defined in the present invention. In case that the conditions of the present invention are satisfied, a desirable heat-sensitive transferring recording medium giving printed images free of irregular printing and smudge, and of good clearness can be obtained.

What is claimed is:

1. A heat-sensitive transferring recording medium which comprises a substrate and a heat-sensitive transferring ink layer overlying the substrate, the heat-sensitive transferring ink layer comprising a coloring agent and two kinds of waxes having melting point of 70°–90° C., penetration (JIS K 2235) of not higher than 5 at 25° C. and specific gravity of 0.99–1.05, one of the waxes having acid value of 120–160 and saponification value of 140–190 and the other having acid value of 1–20 and saponification value of 70–100.

2. A heat-sensitive transferring recording medium according to claim 1 in which the substrate is a heat resistant substrate comprising a plastic film or a paper base provided with a heat resistant protective layer.

* * * * *